US005079800A

United States Patent [19]

Leifeld

[11] Patent Number: 5,079,800

[45] Date of Patent: Jan. 14, 1992

[54] BALE SUPPORTING DEVICE FOR A FIBER BALE OPENER

[75] Inventor: Ferdinand Leifeld, Kempen, Fed. Rep. of Germany

[73] Assignee: Trüzschler GmbH & Co. KG, Monchen-Gladbach, Fed. Rep. of Germany

[21] Appl. No.: 563,322

[22] Filed: Jul. 26, 1990

[30] Foreign Application Priority Data

Jul. 27, 1989 [DE] Fed. Rep. of Germany ..... 3924807

[51] Int. Cl.[5] ..... D01G 7/02

[52] U.S. Cl. ..... 19/80 R

[58] Field of Search ..... 19/80 R

[56] References Cited

U.S. PATENT DOCUMENTS

| | | | |
|---|---|---|---|
| 3,208,107 | 9/1965 | Kotter et al. | 19/80 R |
| 3,663,993 | 5/1972 | Roberson | 19/80 R |
| 3,945,085 | 4/1976 | Katoh et al. | 19/80 R |
| 4,156,954 | 6/1979 | Tibbals | 19/81 |
| 4,308,095 | 4/1983 | Walker et al. | 19/80 R |
| 4,678,128 | 7/1987 | Hergeth | 19/80 R X |
| 4,845,812 | 7/1989 | Kriechbaum et al. | 19/80 R |

FOREIGN PATENT DOCUMENTS

| | | | |
|---|---|---|---|
| 1934854 | 7/1969 | Fed. Rep. of Germany | 19/80 R |
| 197709 | 11/1975 | U.S.S.R. | 19/80 R |
| 180755 | 6/1922 | United Kingdom . | |
| 1102586 | 2/1968 | United Kingdom . | |
| 1258027 | 12/1971 | United Kingdom . | |
| 2018222 | 10/1979 | United Kingdom . | |

*Primary Examiner*—Werner H. Schroeder
*Assistant Examiner*—John J. Calvert
*Attorney, Agent, or Firm*—Spencer & Frank

[57] ABSTRACT

A fiber bale opener includes an upwardly open bale supporting box having a bottom, bale supporting walls together surrounding the bottom for laterally supporting the fiber bale positioned on the bottom; a raising and lowering device connected to the bottom for vertically displacing the bottom and carrier elements for coupling the bottom to the raising and lowering device. The raising and lowering device is situated externally of and horizontally adjacent the box. There is further provided an opening device arranged for a back-and-forth travel above the box to remove fiber material from a top face of the fiber bale positioned on the bottom.

15 Claims, 3 Drawing Sheets

2
2
4
C
9
8
4
3
A
5
B
7
7
34
1
6
13
13
1
11
15
14
D
E
15

9
3
B
A
2
1
1
2
4
4
9a
1
1

BALE SUPPORTING DEVICE FOR A FIBER BALE OPENER

BACKGROUND OF THE INVENTION

This invention relates to an opening apparatus for fiber bales, for example, cotton bales or man-made fiber bales and is particularly directed to a bale-supporting device. The fiber bale opener is of the type which reduces the fiber bales from above by a travelling fiber removal device. The fiber bale opener is of the type which reduces the fiber bales from above by a travelling fiber removal device. The bale support is constituted by an upwardly open crate-like structure having end walls and lateral walls and a bottom or table which is accommodated between the end walls and the lateral walls and on which the fiber bales are supported. The support table, together with the fiber bale supported thereon may be vertically displaced by a raising and lowering device.

According to prior art constructions, the raising and lowering device is arranged underneath the table. It is a disadvantage of such an arrangement that due to the structural height of the raising and lowering device the table cannot be arranged at the level of the plant floor.

SUMMARY OF THE INVENTION

It is an object of the invention to provide an improved apparatus of the above-outlined type from which the discussed disadvantages are eliminated and which, in particular, permits a small structural height and a simple arrangement of the fiber bales underneath the opening device.

This object and others to become apparent as the specification progresses, are accomplished by the invention, according to which, briefly stated, the fiber bale opener includes an upwardly open bale supporting box having a bottom, bale supporting walls together surrounding the bottom for laterally supporting the fiber bale positioned on the bottom; a raising and lowering device connected to the bottom for vertically displacing the bottom and carrier elements for coupling the bottom to the raising and lowering device. The raising and lowering device is situated externally of and horizontally adjacent the box. There is further provided an opening device arranged for a back-and-forth travel above the box to remove fiber material from a top face of the fiber bale positioned on the bottom.

By virtue of the fact that the raising and lowering device is arranged externally of the support walls, the space underneath the table or bottom remains free so that the table may be arranged in the immediate vicinity of the floor whereby the structural height of the apparatus may be reduced. The carrier elements such as rods establish a force transmission between the table and the raising and lowering device.

The bale opener according to the invention is of simple construction, operates automatically and is designed for use with a small number of fiber bales. The reducing device proper has an opening roller and a fixed grate through which the opening roller extends. The reducing device is guided for back-and-forth travel preferably on elevated rails. The carrying away of the removed fiber tufts may be effected by a flexible hose through which a suction air stream is passed. Such a solution is without problems particularly in case only a few fiber bales are opened in one operation. For a lateral shift after each pass, the reducing device may be displaced back and forth relative to the carriage chassis or the rail frame may be moved to the extent of the required lateral shift.

Preferably, the fiber bales are brought in a container underneath the reducing device where the container is immobilized by an arresting arrangement. The container has a movable table which is raised by the hoisting and lowering device. In this manner, a feed of the bales is effected by a vertical upward displacement after each pass of the carriage on which the opening device (reducing device) is mounted. The fiber bales project beyond the container walls so that the opening device may crisscross over the walls. Preferably, the container has removable or downwardly foldable walls to permit an easy charging thereof with the fiber bales. Expediently, the support device is structured such that an empty table within the container may be replaced by an earlier-prepared table on which new fiber bales are supported. The container bottom (table) is, at the beginning of each reducing operation, attached to the stationary raising and lowering device which is operatively coupled with a machine control which controls all drives and operational motions. To achieve a rapid exchange of bale type, the opener rails may lead over two reducing stations so that during the reducing operation in the first station the container is replaced in the second station and is thus prepared as a standby.

DESCRIPTION OF THE PREFERRED EMBODIMENTS

Figure 1:
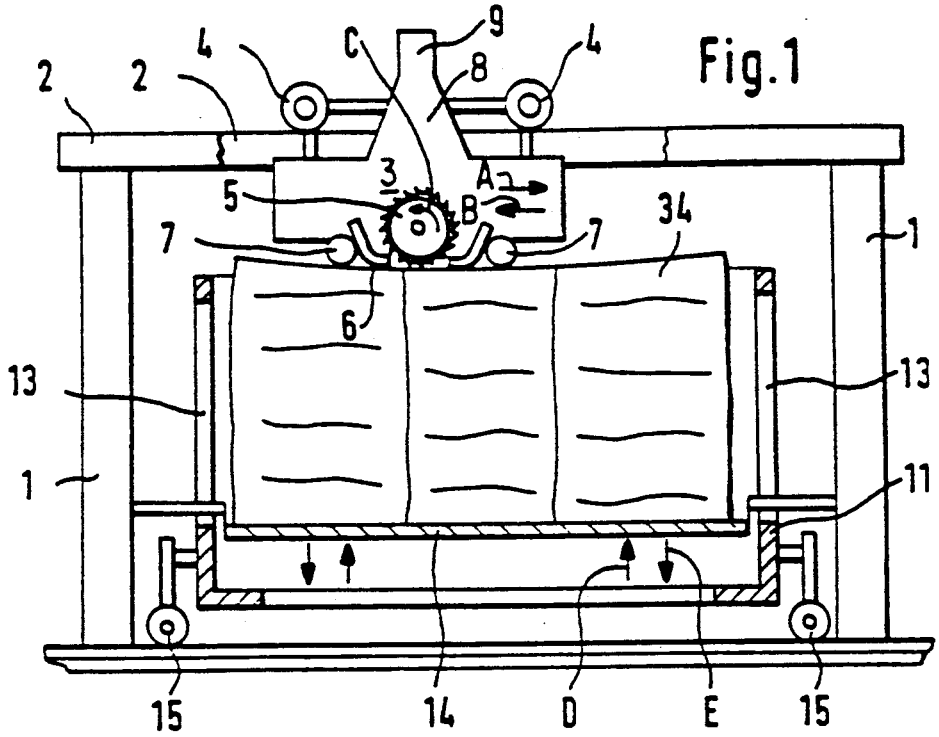
FIG. 1 is a schematic side elevational view of a preferred embodiment of the invention.
Figure 2:
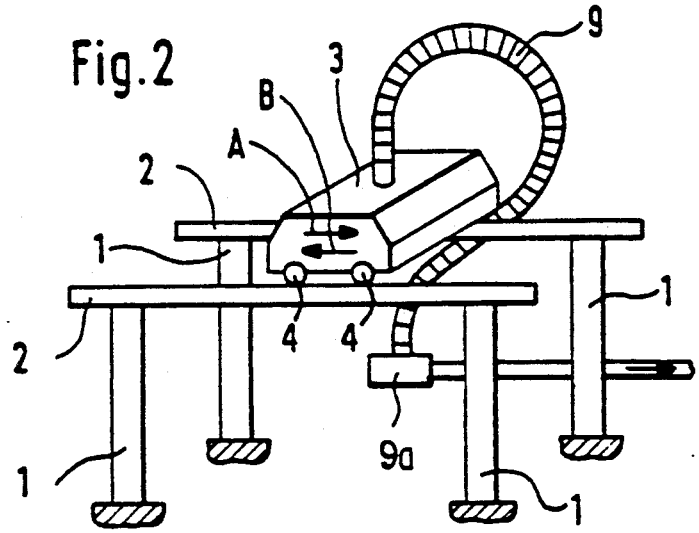
FIG. 2 is a schematic perspective view of a variant of the construction shown in FIG. 1.
Figure 3:
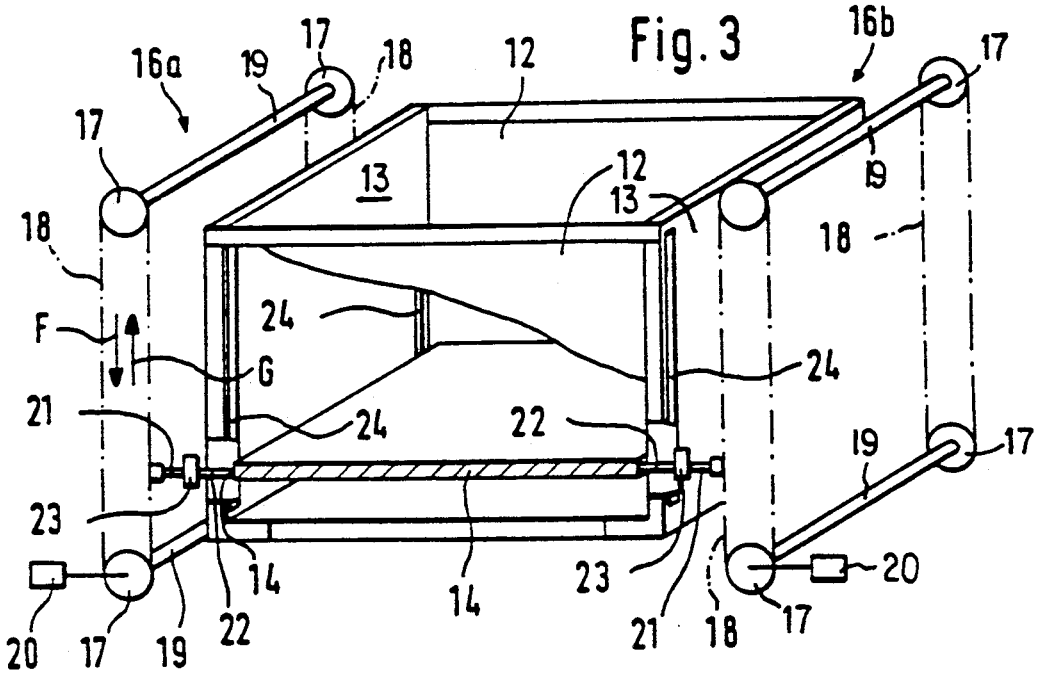
FIG. 3 is a schematic perspective view of the construction of FIG. 1, showing further details of the preferred embodiment.

Turning to FIGS. 1, 2 and 3, the embodiment illustrated therein has four supporting columns 1 which carry on their top two parallel oriented rails 2. A carriage 3 is suspended from (FIG. 1) or supported above (FIG. 2) the rails 2 by rollers 4. On the carriage there is mounted a rapidly rotating opening roller 5, a grate 6 as well as pressing rollers 7. The carriage 3 travels in the direction of the arrows A and B while the opening roller 5 rotates as indicated by the arrow C. Above the opening roller 5 there is arranged a suction hood 8 joined by a flexible hose 9 attached to a vacuum source 9a (not shown in FIG. 1).

Fiber bales 10 are arranged in a box-like container 11 which has two lateral walls 12, two end walls 13 and a bottom 14 which serves as a support table for the fiber bales 10. While the side walls and end walls of the container are stationary during operation, the table 14 is movable vertically within the container in the direction of arrows E and D. The container has four wheels 15 (two are visible in FIG. 1) for displacement of the container on the floor.

Externally of the outer wall faces of the side walls 12 and end walls 13 a hoisting and lowering device is provided which is formed of identically structured components 16a, 16b situated externally of the opposite end faces 13. Each component 16a, 16b has four end rollers 17 arranged to support two vertically oriented, horizontally spaced endless chains 18. The upper and lower rollers 17 are mounted on two vertically spaced, horizontal shafts 19. One of the rollers 17 in each component 16a, 16b is rotated by a respective drive motor 20. To each chain 18 carrier bars 21 are attached. To the four corners of the table 14 carrier elements 22 are secured which may be releasably connected by a respective coupler 23 to a respective carrier element 21. In the opposite end walls 13 of the container 11 respective vertical slots 24 are provided through which the respective carrier elements 22 project.

Figure 4:
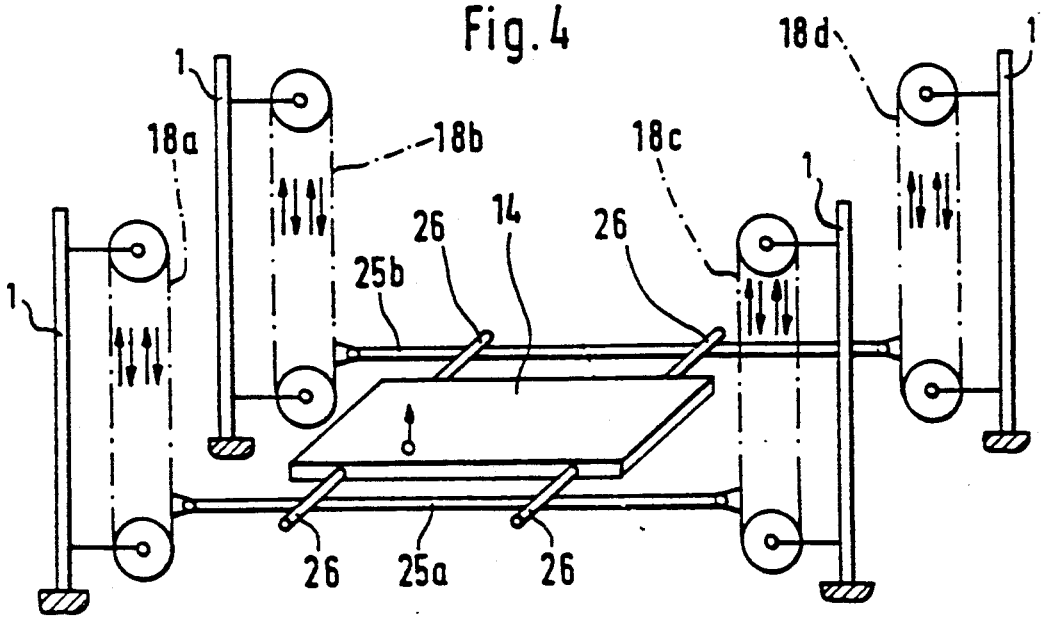
FIG. 4 is a schematic perspective view of another preferred embodiment of the invention.

Turning now to the embodiment shown in FIG. 4, the raising and lowering device has vertical, endless chains 18a–18d, each supported on a separate column 1. The chains 18a and 18c are connected with a carrier element such as a carrier bar 25a and the chain 18b is connected with the chain 18d by a carrier element such as a carrier bar 25b. From opposite sides of the table 14 carrier bars 26 are arranged which lie on carrier elements 25a and 25b and by means of which the table 14 is supported on the bars 26. The latter are raised or lowered in unison as the chains 18a–18d travel unidirectionally.

Figure 5:
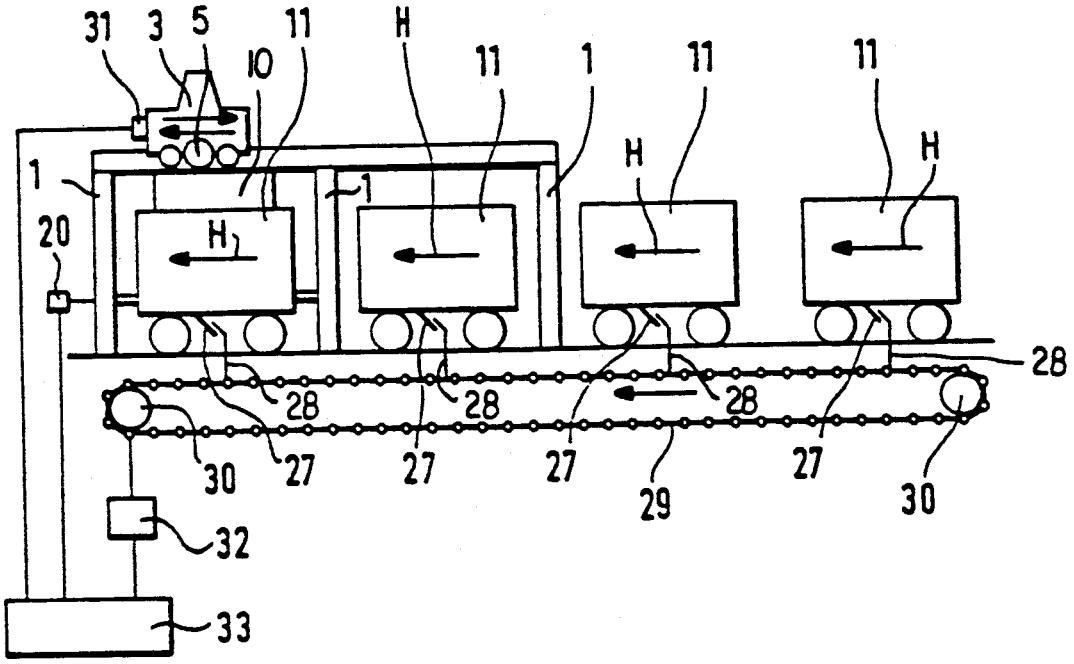
FIG. 5 is a schematic side elevational view of a system incorporating the invention.

Turning now to the embodiment illustrated in FIG. 5, four containers 11 are shown in one row. The carriage 3, with the opening device 5, travels back and forth above the two leftmost containers 11. The direction of travel of the containers 11 is designated with the arrows H. From the underface of each container 11 there extends a coupling member 27 being operatively connected with a respective carrier member 28 mounted on an endless chain 29 supported by end rollers 30. Instead of coupling members 27 it is feasible to provide appropriate apertures in the containers into which the carrier members 28 may engage. A drive motor 31 for the carriage 3, the drive motor 20 for the raising and lowering device 16 as well as a drive motor 32 for the end roller 30a are electrically connected to a common control apparatus 33 such as a microcomputer. In this manner the reciprocation of the opening device 5, the vertical feed of the fiber bale (or bales) 10 and the intermittent advance of the containers 11 may be automatically controlled by the control apparatus 33. The raising and lowering devices in the FIG. 5 structure are not visible; they are accommodated behind the columns 1 visible in FIG. 5.

It will be understood that the above description of the present invention is susceptible to various modifications, changes and adaptations, and the same are intended to be comprehended within the meaning and range of equivalents of the appended claims.

What is claimed is:

1. In a fiber bale opener including an upwardly open bale supporting box having a bottom bale supporting walls together surrounding the bottom for laterally supporting the fiber bale positioned on the bottom; said supporting walls being formed by opposite end walls and opposite side walls having external faces oriented away from said bottom;

a raising and lowering device connected to the bottom for vertically displacing said bottom and an opening device arranged for a back-and-forth travel above the box to remove fiber material from a top face of the fiber bale positioned on the bottom;

the improvement wherein said raising and lowering device is situated externally of and horizontally adjacent said box; further comprising carrier means for coupling said bottom to said raising and lowering device; and means for allowing pivotal motion of at least one of said walls about a horizontal axis downwardly away from said box.

2. A fiber bale opener as defined in claim 1, wherein at least one of said external faces is oriented towards said raised and lowering device.

3. A fiber bale opener as defined in claim 1, wherein said box has wheels for engaging a floor surface to facilitate displacement of the box.

4. A fiber bale opener as defined in claim 1 further comprising a first drive means for operating said opening device, a second drive means for operating said raising and lowering device and a control apparatus connecting the first and second drive means to one another.

5. A fiber bale opener as defined in claim 1 wherein said raising and lowering device comprises a vertically oriented, endless flexible transporting member and end rollers supporting the transporting member; said carrier means being secured to said transporting member.

6. A fiber bale opener as defined in claim 5, further comprising a drive means operatively connected to one of said end rollers.

7. In a fiber bale opener including an upwardly open bale supporting box having a bottom, bale supporting walls together surrounding the bottom for laterally supporting the fiber bale positioned on the bottom; said supporting walls being formed by opposite end walls and opposite side walls having external faces oriented away from said bottom;

a raising and lowering device connected to the bottom for vertically displacing said bottom and an opening device arranged for a back-and-forth travel above the box to remove fiber material from a top face of the fiber bale positioned on the bottom;

the improvement wherein said raising and lowering device is situated externally of and horizontally adjacent said box; further comprising carrier means for coupling said bottom to said raising and lowering device; said carrier means comprising a first carrier element secured to said raising and lowering device, a second carrier element secured to said bottom and a coupler for releasably connecting said first and second carrier elements to one another.

8. A fiber bale opener as defined in claim 7, further comprising means for allowing removal of at least one of said walls from said box.

9. A fiber bale opener as defined in claim 7, further comprising vertical support columns together defining a space accommodating said box; and rails mounted on top of the support columns; said opening device being supported on said rails for travelling thereon.

10. A fiber bale opener as defined in claim 9, wherein said raising and lowering device is secured to said support columns.

11. A fiber bale opener as defined in claim 9, wherein said raising and lowering device is disposed between a pair of said support columns in alignment therewith.

12. In a fiber bale opener including a plurality of upwardly open bale supporting boxes, each having a bottom, bale supporting walls together surrounding the bottom for laterally supporting the fiber bale positioned on the bottom; said supporting walls being formed by opposite end walls and opposite side walls having external faces oriented away from said bottom;

a raising and lowering device connected to the bottom for vertically displacing said bottom and an opening device arranged for a back-and-forth travel above one of the boxes to remove fiber material from a top face of the fiber bale positioned on the bottom;

the improvement wherein said raising and lowering device is situated externally of and horizontally adjacent said box; further comprising carrier means for coupling said bottom to said raising and lowering device; and a horizontally arranged conveyor means for moving the boxes intermittently and sequentially into and out of an operative position underneath the opening device; said conveyor means comprising a conveyor chain and carrier elements connecting said boxes to said conveyor chains.

13. A fiber bale opener as defined in claim 12, further comprising a first drive means for operating said opening device, a second drive means for operating said raising and lowering device, a third drive means for operating said conveyor means and a control apparatus connecting the first, second and third drive means to one another.

14. In a fiber bale opener including an upwardly open bale supporting box having a bottom, bale supporting walls together surrounding the bottom for laterally supporting the fiber bale positioned on the bottom; said supporting walls being formed by opposite end walls and opposite side walls having external faces oriented away from said bottom;

a raising and lowering device connected to the bottom for vertically displacing said bottom and an opening device arranged for a back-and-forth travel above the box to remove fiber material from a top face of the fiber bale positioned on the bottom;

the improvement wherein said raising and lowering device is situated externally of and horizontally adjacent said box; further comprising carrier means for coupling said bottom to said raising and lowering device; said carrier means comprising a first carrier element secured to said raising and lowering device and a second carrier element secured to said bottom and lying on said first carrier element; said first and second carrier elements being horizontal carrier bars oriented transversely to one another.

15. In a fiber bale opener including an upwardly open bale supporting box having a bottom, bale supporting walls together surrounding the bottom for laterally supporting the fiber bale positioned on the bottom; said supporting walls being formed by opposite end walls and opposite side walls having external faces oriented away from said bottom;

a raising and lowering device connected to the bottom for vertically displacing said bottom and an opening device arranged for a back-and-forth travel above the box to remove fiber material from a top face of the fiber bale positioned on the bottom;

the improvement wherein said raising and lowering device is situated externally of and horizontally adjacent said box; further comprising carrier means for coupling said bottom to said raising and lowering device; and further wherein at least one of said supporting walls has a vertical opening through which said carrier means passes; said vertical opening allowing vertical motions of said carrier means relative to said supporting walls.

* * * * *